United States Patent [19]

Shimek et al.

[11] Patent Number: 4,852,548

[45] Date of Patent: Aug. 1, 1989

[54] UNIVERSAL FIREPLACE ASSEMBLY

[76] Inventors: Ronald J. Shimek, 8944 W. 154 St., Prior Lake, Minn. 55372; Daniel C. Shimek, 5260 W. 132nd St., Apple Valley, Minn. 55124

[21] Appl. No.: 200,536

[22] Filed: May 31, 1988

[51] Int. Cl.[4] ..... F24B 1/181; F24B 1/19

[52] U.S. Cl. ..... 126/518; 126/519; 126/548; 126/551; 126/500; 126/193

[58] Field of Search ..... 126/62, 64, 65, 120, 126/121, 193, 500, 515, 518, 519, 544, 547, 548, 551

[56] References Cited

U.S. PATENT DOCUMENTS 4,169,458 10/1979 Shaw ..... 126/120
4,177,793 12/1979 Johnson ..... 126/121
4,224,921 9/1980 petrescue ..... 126/121
4,287,871 9/1981 Schumann et al. ..... 126/121 X
4,304,215 12/1981 Jarmen ..... 126/121

*Primary Examiner*—Margaret A. Focarino
*Attorney, Agent, or Firm*—John B. Sowell

[57] ABSTRACT

A universal fireplace is provided as standard prefabricated substantially hollow rectangular prism shaped frame adapted to support all six walls of the universal fireplaces supported on the hollow rectangular prism shaped frame. The top wall is adapted to support the exhaust stack and the bottom wall is adapted to support the fire brick for the fire chamber. At least one of the sidewalls comprises a pair of glass doors supported by edge frame means pivoted on upper and lower side support panels which are mounted on said hollow rectangular prism shaped frame.

18 Claims, 4 Drawing Sheets

UNIVERSAL FIREPLACE ASSEMBLY

BACKGROUND OF THE INVENTION

1. Related Applications and Inventions

This application is related to our U.S. Pat. No. 4,112,913 issued Sept. 12, 1978 and constitutes an improvement thereof.

2. Field of the Invention

The present invention relates to fireplaces in general and more particularly to fireplaces which may be finally assembled as freestanding fireplaces, zero clearance fireplaces, see through fireplaces, four side glass panel fireplaces or three side glass panel fireplaces.

3. Description of the Prior Art

The purpose of the present invention is to provide a standard or universal prefabricated factory assembled fireplace that is capable of being finally assembled as a number of different fireplaces to standards which meet the fire insurance underwriters requirements when completed in any of the different number of fireplace configurations.

Numerous fireplace manufacturers provide standard lines of fireplaces which include all of the aforementioned fireplaces except four glass sided fireplaces. Heretofore, such fireplaces were designed for a single purpose and were not easily convertible from one fireplace configuration to another fireplace configuration without a major redesign or a custom design unit being built.

Our U.S. Pat. No. 4,112,913 shows and describes a freestanding heating unit of the type having a large number of glass panels in a non-zero clearance configuration. This patent also teaches it is possible to introduce a stream of clean air at the bottom of the glass panels which sweeps or cleans the interior surface of the thermal glass panels with air to prevent the deposit of unburned hydrocarbons on the glass. The purpose of the glass panels and the metal top and bottom portions of this heating unit serve to radiate heat to surrounding objects, thus, this unit cannot be installed close to any combustible wall or enclosure and may not be used as a zero clearance fireplace.

Our co-pending U.S. application Ser. No. 06/927,744, now U.S. Pat. No. 4,793,322, shows and describes a zero-clearance direct vented gas fireplace which may be installed against an exterior wall of a room in an existing building or installed in a new building without requiring a separate chimney structure. All of the six walls of this rectangular prism shaped fireplace are provided with double air wall space having moving cool air circulated through the walls to provide cooling of the walls which is sufficient to enable the cooled walls to be installed adjacent a combustible floor or wall. The glass doors of this fireplace are also cooled and cleaned by combustion air to increase radiation efficiency but mainly to avoid smoking the glass panels in the doors which would detract from the brilliance of the fire and the aesthetic appeal of the heating unit.

Fireplaces manufactured heretofore, including our aforementioned fireplaces, are provided with walls, doors and panels which are assembled and screwed, bolted, welded or otherwise attached to the prefabricated sheet metal or steel in an interconnected unit so that any alteration or modification cannot be easily be accomplished. Similarly, the manner in which the prior art fireplaces are manufactured does not permit alteration or modification after the fireplace has been assembled on a production line. When the production of these prior art fireplaces reaches a quantity great enough to merit a dedicated production line, such prior art fireplaces can be made by cost efficient mass production methods. However, when such a fireplace must be modified to meet a special application the modification or custom alteration cannot be accomplished on a production line nor can the fireplace be made by high production cost efficient mass production methods.

Another problem associated with designing fireplaces for mass production cost efficient methods is that a dedicated production line ordinarily requires expensive tooling and unless the dedicated production line is employed at its optimal efficiency the cost of the units would be prohibitive. Accordingly, heretofore it has not been possible to produce specialty fireplaces or custom fireplaces for special decor requirements on high production low cost production assembly lines.

It would be extremely desirable to provide a universal fireplace which can be made by high production methods at low cost on a dedicated production line using low cost tooling to provide an assembly with as many as seven different fireplace configurations using the same basic fireplace assembly made on the mass production line for the different configurations.

SUMMARY OF THE INVENTION

A principal object of the present invention is to provide a universal fireplace made by mass production means which may be finally assembled into different fireplace configurations by assembling different side walls and door combinations thereto.

Another principal object of the present invention is to provide a universal fireplace which may be assembled as a freestanding fireplace, zero clearance fireplace, a see through fireplace, a three side glass oasis fireplace and/or a four side glass island fireplace.

Another object of the present invention is to provide a universal fireplace which is easy to assemble and adjust without the requirement of special tooling.

Another principal object of the present invention is to provide a glass door and glass side walls with novel cooling means and combustion gas diverting means which permits the use of inexpensive low temperature tempered glass in the panels and doors instead of expensive high temperature glass.

Another object of the present invention is to provide novel edge frame extrusions for mounting fixed glass plates or for mounting and pivoting glass doors.

A general object of the present invention is to provide novel smoke diverter means which permits the novel universal fireplace to be operated smoke free when one or more of the glass doors on the fireplace are left open.

According to these and other objects of the present invention there is provided a universal fireplace assembly of the type having four side walls, a top wall and a bottom wall. Said fireplace assembly is manufactured on a cost efficient high production line employing a substantially hollow rectangular prism shaped frame for supporting all six walls of the universal fireplace assembly. Said hollow rectangular prism frame serves as a precision mounting and support means for novel bottom walls and novel top walls and novel side walls to permit final assembly of the fireplace and numerous fireplace configurations.

DESCRIPTION OF THE PREFERRED EMBODIMENT

Figure 1:
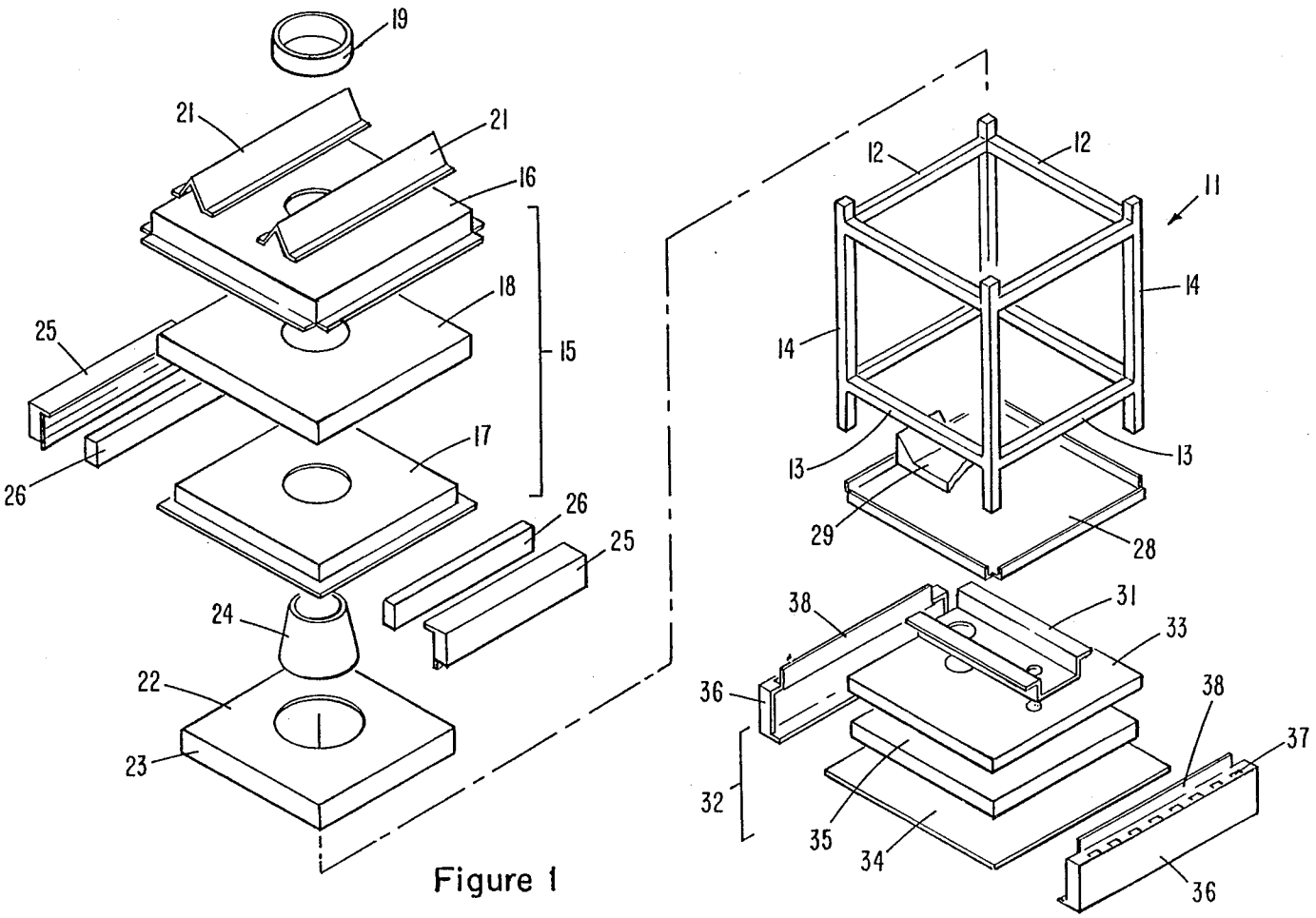
FIG. 1 is an exploded view of the novel rectangular prism shaped frame surrounded by shaped steel sheets which comprise top and bottom wall means and top and bottom support shields.

Refer now to FIG. 1 showing in an exploded view the parts which comprise a universal fireplace assembly. Fireplace assembly 10 comprises a rectangular prism frame 11 which in the preferred embodiment is manufactured by welding square hollow structural members together after being precision cut and placed in a precision jig to produce the precision frame 11. Frame 11 comprises horizontal mounting members 12 and 13 at the upper and lower portions of the frame. Members 12 and 13 are preferably welded to vertical legs or support columns 14 to provide a structural rigid assembly. It will be understood that other shapes of structural members may be employed in a rectangular prism configuration for mounting the shaped sheet metal components to be described hereinafter thereon. The top wall 15 comprises an outer sheet metal piece 16 and inner sheet metal piece 17 and an insulation sheet 18 which are connected together to form a top wall sandwich. A collar 19 and stand off brackets 21 are attached to outer sheet metal panel 16.

Smoke shield means 22 is provided with downward depending diverter portions 23 on all four sides as will be explained in greater detail hereinafter. The upper portion of diverter 23 connects to the bottom of panel 17 and provides an air space therebetween. Smoke shield 22 also serves as the top of the fire chamber or fire box and has connected thereto exhaust stack adapter which extends through apertures in panels 15 to 17. All four sides of the assembly 10 are provided with upper support shields 25 which have block insulation 26 installed therein.

Bottom wall means 27 comprises a fire brick support panel floor 28 for supporting fire brick 29 and has connected to the bottom thereof a channel shaped preheat support 31 which is spaced apart from the outer portion 32 of bottom wall 27. The outer portion of the bottom wall comprises an upper panel 33, a lower panel 34 and an insulation block panel 35 therebetween forming a sandwich panel. Four bottom support shields 36 are shown provided with a plurality of fresh air ports 37 and an upward depending flange 38 which may be supplemented by a lower air deflection diverter (not shown) which will be explained in greater detail hereinafter.

Figure 2:
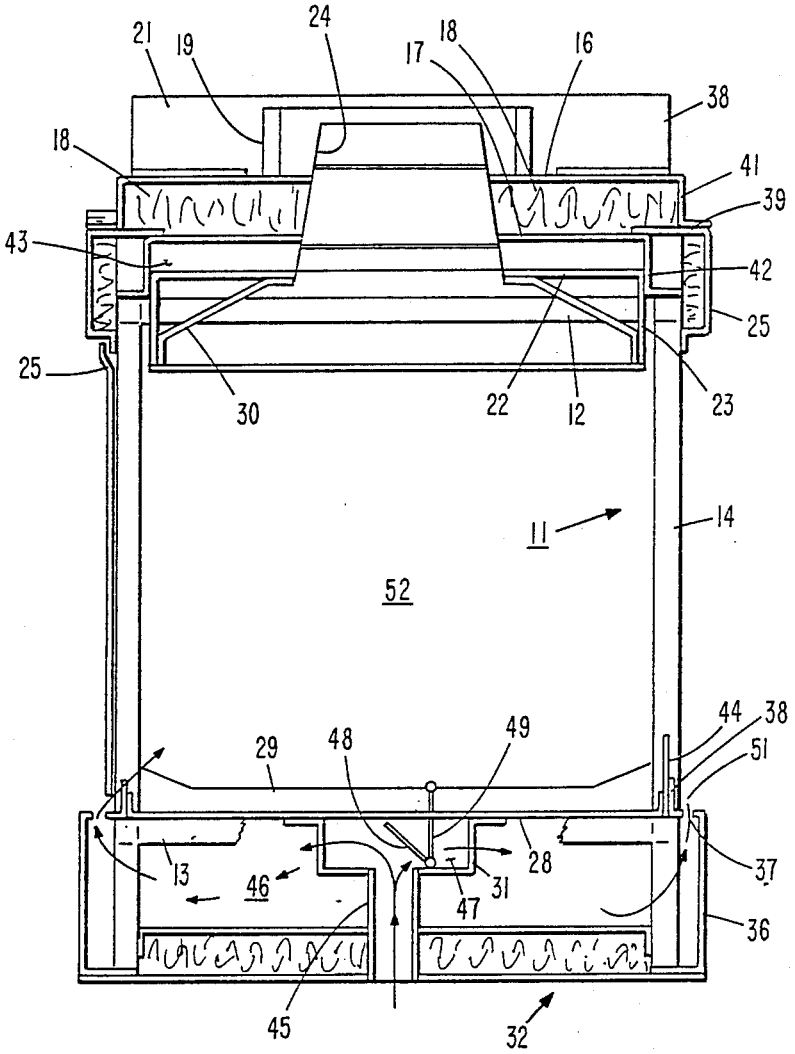
FIG. 2 is an enlarged schematic section and elevation taken through the novel frame structure of FIG. 1 showing details of the bottom and top walls and support shields.

Refer now to FIG. 2 which is an enlarged schematic section in elevation taken through the frame 11 showing details of the bottom and top walls and the support shields. Elements previously explained with regards to FIG. 1 are numbered the same in FIG. 2 and may not require a detailed explanation of their functional connections. The four upper support shields 25 are provided with long horizontal connecting flanges 39 which cross over the tops of the vertical columns or supports 14. The horizontal extending flange 39 provides a mounting structure for the outer L-shaped leg 41 of panel 16. The lower panel 17 traps the insulation 18 between panel 16 to form a sandwich therewith. An L-shaped leg 42 on panel 17 mounts on top of the four upper horizontal bars 12 of frame 11. The downward depending diverter 23 of the smoke shield 22 is connected at its uppermost portion to the downward depending leg 42 to provide an airspace 43 between the top of the panel and the bottom of panel 17. It will be understood that the novel upper shields and top wall are capable of supporting loads up to 2000 pounds applied to the exhaust stack adapter 24. This load is transmitted to panel 17 and panel 22 so as to transfer the vertical load through the L-shaped legs 42 into the horizontal mounting members 12 of frame 11. The panels and side shields 25 are not the major load carrying members and thus may be attached to other panels for support instead of being attached directly to the novel support frame 11.

Fire brick support panel 28 is shown overlapping and supported lower horizontal frame members 13 and connected by their upward depending flanges to the upward depending flanges 38 of bottom support shields 36. A diverter panel 44 is shown positioned between the upward depending flanges of panel 28 and shield 36 as an alternative to extending flange 38 higher. Fire brick 29 fills the panel 28 to the edges and is preferably made in sections so that it will support a grate and logs without cracking. Channel preheat support 31 is shown attached to the bottom of panel 28 and provides a rigidifying and reinforcing structure therefor. The outer portion 32 of bottom wall 27 is provided with a fresh air inlet 45 which also provides a rigid vertical center support. The space between panel 28 and portion 32 comprises a fresh air plenum which is filled with fresh air after being preheated and passing into the channel preheat support 31 and passing out through the ends and apertures provided therein. Damper closure means 48 are shown in the upper open position under control of control rod 49 which connects to damper 48 and extends through an outer wall for manual control purposes.

In the event that a fresh air pipe cannot be connected to inlet 45 and/or the fireplace is mounted on a slab or flat floor, the fresh air inlet may be closed off by moving damper 48 to the closed position. Some such dampers are preferably slidable instead of pivotal as is well known. When fresh outside air is supplied to inlet pipe 45 of plenum 46 through a side wall, the fresh air preferably is first conducted to the preheat channel 31 where it is preheated before passing into the plenum 46 and through apertures 51 in lower shields 36 and then passing under the glass panels or glass doors as will be explained in detail hereinafter before the entering the combustion chamber 52. It will be understood that plenum 46 operates as a dead air insulating space when damper 48 is closed and when these conditions exist the combustion air will be brought in under the glass panels or glass doors as will be explained in detail hereinafter.

Figure 3:
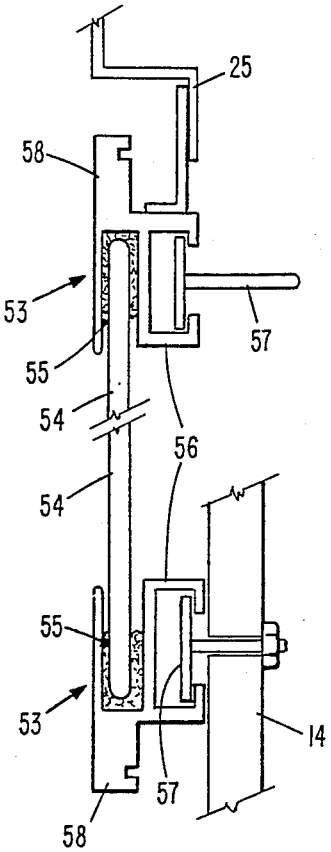
FIG. 3 is an enlarged elevation and partial section showing a side wall panel for mounting a plate of tempered glass onto the novel frame of FIGS. 1 and 2.

Refer now to FIG. 3 showing the novel edge mounting means 53 for supporting either a glass panel 54 or the glass of a pivoting door which will be explained hereinafter. Edge mounting means 53 is preferably an extruded aluminum shape having a recess wider than the thickness of the glass 54 for receiving an end portion of glass 54 which is coated with silicon 55 before being inserted. Extrusion 53 comprises a channel shaped member 56 which provides a slot for receiving a rectangular headed bolt 57 adapted to be bolted to a vertical leg 14 or to one of the sheet metal panels as explained hereinbefore. It will be understood that channels 56 when mounted horizontally provide a stand off air space between the channel 56 and the aforementioned diverter 44. Downward leg 58 of member 53 serves to strengthen the extrusion and provide ornamental appeal over the open path through which the combustion and cooling air enters.

In similar manner an extrusion 53 having a channel 56 is shown connected to the top of glass panel 54 and connected to upper support shield 25. Glass panels or glass side walls are preferably mounted to the frame 11 but may be mounted to the sheet metal described hereinbefore, but in the end analysis are supported by the frame 11.

Figure 4:
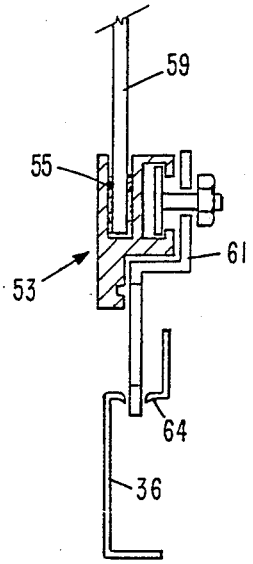
FIG. 4 is an enlarged elevation and partial section showing a bottom edge frame for supporting and mounting and pivoting a tempered glass door on a bottom support shield.
Figure 5:
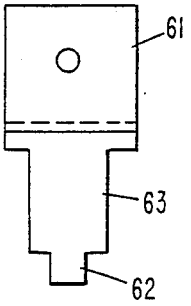
FIG. 5 is an enlarged front view of a novel pivot support which attaches to the bottom edge frame of FIG. 4.
Figure 6:
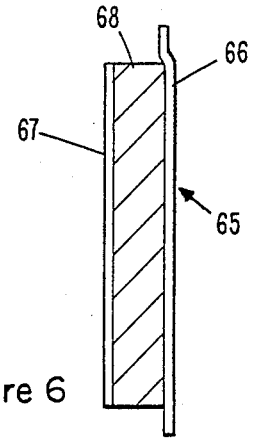
FIG. 6 is an enlarged elevation and partial section showing an insulation sandwich panel of the type which is mounted on said bottom and top support shield.

Refer now to FIGS. 4 and 5 showing enlarged elevations and a partial section of an edge mount 53 adapted to receive a glass panel 59 of a pivotable glass door. Channel 56 is shown connected to Z-shape pivot support member 61 which is provided with a small pivot pin 62 and a large pivot pin 63. It will be understood that the small pivot pin 62 extends through a pivot aperture 64 of a bottom support shield 36. The aperture (not shown) in the upper support shield 25 is larger than the aperture 64 and receives the large pivot pin 63 so that the glass door may be first inserted in the upper aperture far enough to permit the small pivot pin to extend over the aperture 64 and be dropped therein for rapid insertion and removal of the pivotable glass panel doors Refer now to FIG. 6 which is an enlarged elevation and partial section of an insulation sandwich panel employed for a blind sidewall. The blind sidewall 65 comprises a outer sheet metal member 66 and inner sheet metal member 67 and a sandwich of insulation 68 therebetween. The ears or flanges at the bottom and top of inner sheet metal member 67 are adapted to be directly connected to the outside surface portion of the upper and lower support shields 25 and 36 respectively. It will be understood that blind sidewall 65 is preferably connected in such a manner that no cooling air enters at the top or bottom edges of outer panel 66, however, a dead air space or air cooling could be utilized. The edge panel portions may be supplied with decorative trim and extended to the edge portions of the vertical legs 14 so as to provide a neat closed tolerance structure cooperating with the panels which are mounted adjacent thereto.

Figure 7:
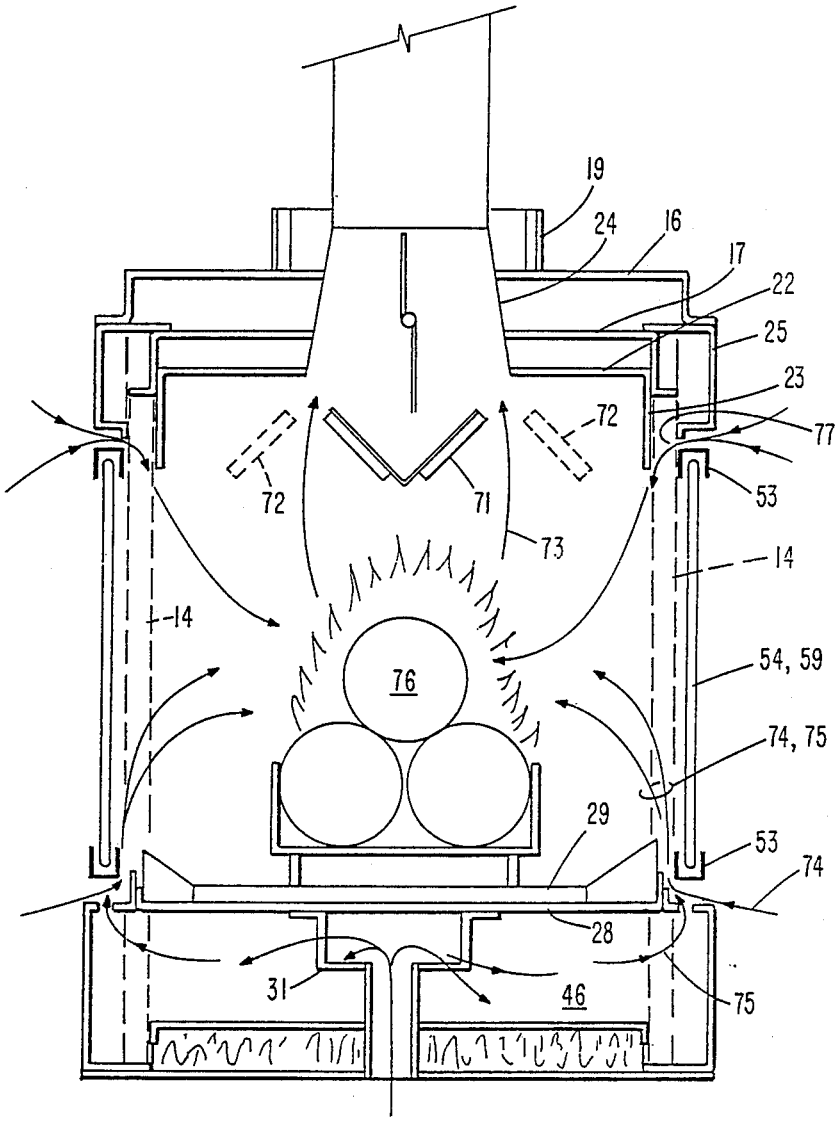
FIG. 7 is a schematic section and elevation showing the air inlet paths of the diverted air which cools the tempered glass and the structural diverters employed in the smoke shields.

Refer now to FIG. 7 showing a schematic section and elevation for purposes of illustrating the air inlet path of air supplied from a surrounding room or from the aforementioned fresh air inlet which is employed to cool the tempered glass. FIG. 7 also illustrates a modified form of diverters employed in the smoke shields 69 described hereinbefore. A diverter 30 was previously described as a preferred embodiment with regards to FIG. 2 for diverting the exhaust gases away from the sidewalls and directly into the exhaust stack 24. Similar diverters 72 are shown in phantom lines in FIG. 7. Another form of diverter 71 is formed as a V-shaped member and extends longitudinally along the longest axial direction of the rectangular fireplace 10 and is employed to divert the exhaust gases shown by lines 73 around the diverter 71 and then into the exhaust stack 24. Fresh air lines 74 illustrate the path of inside air passing under the glass panel 54 or door glass panel 59 as the case may be. However, when outside fresh air is provided through fresh air inlet 45 or equivalent fresh air means through plenum 46, the fresh air exits from the plenum through fresh air port 37 and then passes under the opening under the glass panel or door as shown by lines 75. As explained hereinbefore, it will be understood that when the damper 48 is closed all air must be taken from some source other than the inlet 45. The draft induced by the burning of the logs 76 also pulls outside air in through aperture 77 which extends inside of glass panel 54, 59 and downward vertically alongside downward diverter 23 of smoke shield 22.

Having explained a preferred embodiment and a modification thereof it will be understood that the novel fireplace assembly 10 shown in FIG. 1 and 2 may be made on a highly efficient assembly line by employing the cheapest form of tooling and at the end of the assembly line each of the fireplace assemblies may be tailored to the configuration desired by the customer or shipped as shown in FIGS. 1 and 2 along with the necessary panels to complete the custom fireplace in its enclosed form. An advantage to making a fireplace in the manner described hereinbefore permits the retailers to offer numerous configurations of fireplaces while incurring the minimum inventory cost The novel and simple manner in which the side panels are assembled to the highly precise rectangular prism frame 11 permits those of even nominal skill to finish the assembly of a custom made fireplace for numerous environments. For example, the novel fireplace may have four glass sides and is adapted to support a columnar wall as well as the weight of a chimney stack when the fireplace is installed in a free standing environment.

More importantly, the novel fireplace may be installed between rooms for room dividers and in a see through configuration or in three sided configurations or as a complete island. More importantly the novel fireplace may be installed as a zero-clearance fireplace against an interior wall or an exterior wall and finished in a custom built home or installed as a retrofit at minimum cost.

Even though the present invention structure has been explained as a wood burning fireplace, the same structure can be modified to accept gas burning logs or a direct vent gas fireplace system of the type described in our copending application No. 06/927,744, now U.S. Pat. No. 4,793,322.

What we claim is:

1. A universal fireplace of the type having four sidewalls, a top wall and a bottom wall wherein at least one of said sidewalls is provided with economical heat resistant glass comprising:

a substantially hollow rectangular prism L-shaped frame for supporting all six walls of said universal fireplace, said hollow rectangular prism frame comprising a plurality of structural steel formed shapes welded together to form a rigid support frame, bottom wall means connected to said rectangular prism frame forming a bottom closure for said frame, top wall means connected to said rectangular prism frame forming a top closure for said frame, a plurality of bottom support shields connected to said bottom wall means and to the bottom of said rectangular prism frame for uniformly distributing the weight of said fireplace onto said rectangular prism frame, a plurality of top support shields connected to said top wall means and to the top of said rectangular prism frame for uniformly distributing the weight of said fireplace onto said rectangular prism frame, smoke shield means supported by said rectangular prisms frame for diverting smoke to an exhaust stack, exhaust outlet means extending through said smoke shield means and said top wall means for receiving an exhaust stack, and four sidewall panels each being supported by said rectangular prism frame and said bottom support shields and nesting between pairs of said bottom and said top support shields.

2. A universal fireplace as set forth in claim 1 wherein said bottom wall means comprises insulation sandwich means.

3. A universal fireplace as set forth in claim 2 wherein said bottom wall means further comprises fire brick support means spaced apart from said insulation sandwich means and forming an air plenum therebetween.

4. A universal fireplace as set forth in claim 3 which further includes preheat support means attached to the bottom of said fire brick support means.

5. A universal fireplace as set forth in claim 4 which further includes fresh air inlet means connected to said preheat support means.

6. A universal fireplace as set forth in claim 5 which further includes closure plate means movably mounted for closing off said fresh air inlet.

7. A universal fireplace as set forth in claim 3 which further includes fresh air supply apertures in said bottom support means for supplying fresh outside air to the bottom of the sidewall panels having glass therein and for supplying combustion air and for cooling said tempered glass.

8. A universal fireplace as set forth in claim 1 wherein at least one of said side walls comprises a pair of glass doors supported by edge frame means and pivoted on said upper and said lower support panels.

9. A universal fireplace as set forth in claim 8 wherein said edge frame means are spaced apart from upper and said lower support panels for supplying cooling air across said glass in said glass doors.

10. A universal fireplace as set forth in claim 9 wherein said smoke shield comprises downward depending deflector plates at the peripheral edge for deflecting smoke inward toward said exhaustion outlet means and for deflecting downward fresh air entering the top edge of said glass doors.

11. A universal fireplace as set forth in claim 9 wherein said smoke shield further comprises hot gas diverter plates mounted inside said smoke shield means for diverting hot smokey exhaust gas directly into said exhaust outlet means.

12. A universal fireplace as set forth in claim 1 wherein said top wall means comprises insulation sandwich means forming an outer top wall portion.

13. A universal fireplace as set forth in claim 12 wherein said insulating sandwich means comprises downward depending flanges at the peripheral edges attached to the top of said smoke shield means.

14. A universal fireplace as set forth in claim 13 which further includes a dead air space between said top wall means and the top of said smoke screen means

15. A universal fireplace as set forth in claim 1 wherein one of said sidewalls comprise insulating sandwich means having upper and lower extending flanges connected to said upper and lower support shields for providing a zero clearance blind side panel.

16. A universal fireplace as set forth in claim 1 wherein one of said sidewalls comprises a tempered glass plate having a perimeter frame all around said glass plate, and attachment means connected to said perimeter frame and to said support shields.

17. A universal fireplace as set forth in claim 1 wherein one of said sidewalls comprises a pair of tempered glass doors pivotally mounted in said upper and said lower support shields.

18. A universal fireplace as set forth in claim 17 wherein said tempered glass doors are provided with edge frame means for supporting said glass doors, and pivotal support means attached to said edge frame means and mounted in pivot apertures in said support shields.

* * * * *